US006033788A

United States Patent [19]

Cawley et al.

[11] Patent Number: 6,033,788

[45] Date of Patent: Mar. 7, 2000

[54] PROCESS FOR JOINING POWDER METALLURGY OBJECTS IN THE GREEN (OR BROWN) STATE

[75] Inventors: James D. Cawley, Shaker Heights; William H. Glime, Westlake; Brian D. Kernan, Cleveland Heights, all of Ohio

[73] Assignee: Case Western Reserve University, Cleveland, Ohio

[21] Appl. No.: 08/969,872

[22] Filed: Nov. 14, 1997

Related U.S. Application Data

[60] Provisional application No. 60/030,965, Nov. 15, 1996.

[51] Int. Cl.[7] ..... B22F 7/02

[52] U.S. Cl. ..... 428/548; 428/546; 75/228; 419/2; 419/5; 419/39; 419/44; 419/54; 419/55

[58] Field of Search ..... 419/2, 5, 44, 39, 419/54, 55; 75/228; 428/546, 548

[56] References Cited

U.S. PATENT DOCUMENTS

| | | | |
|---|---|---|---|
| 2,319,323 | 5/1943 | Heyroth | 201/76 |
| 2,522,082 | 9/1950 | Arnold | 18/48 |
| 3,227,591 | 1/1966 | Lambert et al. | 156/89 |
| 3,359,623 | 12/1967 | Gwyn, Jr. | 29/420.5 |
| 3,384,951 | 5/1968 | Binger | 29/495 |
| 3,666,006 | 5/1972 | Valyl | 165/164 |
| 3,716,347 | 2/1973 | Bergstrom et al. | 29/182.2 |
| 3,717,442 | 2/1973 | Knopp | 29/182.2 |
| 3,743,556 | 7/1973 | Breton et al. | 156/62.8 |
| 3,791,798 | 2/1974 | Joyce et al. | 29/182.2 |
| 3,889,349 | 6/1975 | Kaufman | 228/173 |
| 4,484,972 | 11/1984 | Ebata et al. | 156/325 |
| 4,608,225 | 8/1986 | Sakuramoto et al. | 419/5 |
| 4,614,296 | 9/1986 | Lesgourgues | 228/194 |
| 4,681,733 | 7/1987 | Konishi et al. | 419/8 |
| 4,729,871 | 3/1988 | Morimoto | 419/2 |
| 5,288,351 | 2/1994 | Hoang et al. | 156/89 |
| 5,592,686 | 1/1997 | Third et al. | 419/2 |
| 5,846,664 | 12/1998 | Third et al. | 428/550 |

*Primary Examiner*—Daniel J. Jenkins
*Attorney, Agent, or Firm*—Fay, Sharpe, Fagan, Minnich & McKee

[57] ABSTRACT

In a process for producing powder metallurgy objects containing two or more individually formed pieces, the individual formed pieces or powder compacts which are comprised of powder and a binder are joined together. A polymer compatible with the binder is sandwiched between two such powder compacts. A lamination joint is formed. The polymer is then softened, and a resultant aggregate body is thermally processed to remove the binder and polymer. The resulting object has no residual interface between the original individually formed pieces. There is no discernable boundary at the lamination joint. The final part is homogeneous and uniform with no foreign material or structural imperfections at the joint.

27 Claims, 7 Drawing Sheets

18

PROCESS FOR JOINING POWDER METALLURGY OBJECTS IN THE GREEN (OR BROWN) STATE

This application claims the benefit of Provisional 60/030,965 filed Nov. 15, 1996.

BACKGROUND OF THE INVENTION

The present invention pertains to the art of metallurgy and materials science, and more particularly to a process for producing powder metallurgy or ceramic or glass objects of simple or complex geometries. The invention is particularly applicable to a process for joining powder metallurgy objects in the green or brown state to form larger or more complex parts. It will be appreciated that the invention may be advantageously employed in other environments and applications.

Although quite complex metallic shapes can be fabricated via a number of primary processes such as casting, forging, machining, and various powder-processing methods such as powder injection molding (PIM), all of these processes suffer some limitations in permissible part geometry. The limitations of the various forming methods, be they economic or technological, often dictate that a secondary joining operation is preferable or required.

A number of different techniques are currently known and used to join dense monolithic parts. These include: welding, brazing, soldering, reaction bonding, adhesive joining, and use of mechanical fasteners. However, such methods generally create non-uniform structures. For example, in the case of a weld, even though its composition may be nominally the same as the base metal, the joint material and/or "heat affected zone" of the base metal has a microstructure and concomitant properties that differ from the base metal, often substantially. In the case of soldering, brazing, and adhesive joining, a foreign material is left in the joint. Mechanical fasteners require holes that can serve as stress concentrators, and often the design must be constrained to allow access during assembly. These techniques, developed for dense monolithic materials, are also used currently for powder processed components after they are densified.

The three most prevalent methods for shaping parts are casting, deformation processing, and machining. In casting, the material is melted and poured into a mold. The liquid takes the shape of the mold cavity under some combination of gravity and pressure, and subsequent solidification results in the permanent storage of the shape information. In deformation processing, the material is typically heated to lower the effective yield stress and a shaped tool is brought to bear against the plastic mass under external pressure sufficient that permanent deformation occurs. The part typically retains its shape when the stress is removed. The familiar process of machining involves selective removal of material from the surface of a solid object by the action of a machine tool. In all of these processes, the metal is a dense solid monolith at the end of the shaping process. Powder processing, however, is different.

In powder processing, shaping is often mediated through the presence of a carrier fluid, which can be a water-based solution, mixture of organic liquids, or molten polymers. Metal, ceramic and glass powders can be processed with equal facility. The mixture can be made to emulate a liquid; a plastic, or a rigid solid by controlling the type and amount of carrier and the ambient conditions (e.g., temperature). The result of the shaping process is a "green" (i.e., unfired) powder compact that is a solid, but has an internal structure that consists of discrete powder particles held together by the action of a binder (usually a component of the carrier fluid). The powder compact is converted to a dense solid (and the microstructure is developed) through subsequent thermal processing to burnout, or pyrolize, the organic phase and densify, or sinter, the inorganic powder. An alternative method for densifying the part is to thermal process only to eliminate the binder and develop a modest amount of bisque strength followed by infiltration with a melt of a less refractory material. Both sintering and infiltration can be used with equal facility for powder metals, ceramics, and glasses.

The fact that powder processing involves two qualitatively different solid states offers the possibility of executing the joining process before processing has progressed to the point where the final microstructure of the material, and concomitant properties, are obtained. By working in the green state, the joining operation can form a bond through action on the organic binder, rather than directly on the metal or ceramic. A crucial constraint on any joining operation is that it be compatible with subsequent thermal processing and not interfere with densification. The state of a powder compact to be joined is dependent on the nature of its binder system which, in turn, is dictated by the need to be compatible with the primary processing operation. For example, many processes that employ a solvent-binder solution (e g, tape casting or gelcasting) produce compacts that are porous at the conclusion of a low-temperature drying step during or immediately after shaping. In cases where the binder is solidified (e.g., injection molding), the powder compact is usually nonporous. PIM feedstocks are generally composed of small inorganic particles dispersed in an organic medium. In the latter case, in particular, it is advantageous to employ binder systems that consist of a mixture of two or more materials. During binder removal, the process conditions are controlled such that one component of the binder is preferentially removed while the other remains in the compact. At this intermediate stage, the powder compact develops porosity and becomes functionally equivalent to a compact of the type produced with a solvent-based system. The presence of at least near-surface porosity is important for the joining process.

The process of the present invention is general and can be used with success to join two or more powder compacts regardless of the primary process used to define their shape. There are many situations in which there is a strong need to employ a joining operation, and representative solutions described herein are intended for illustration purposes only, and should not be viewed as limiting the scope of the invention.

The first representative situation concerns the production of large parts. For example, one technological limitation of the powder injection molding process has been the size limitation due to solidification shrinkage of the polymeric binder/carrier fluid. Typically, this limits the maximum thickness of molded objects to less than 1 inch. For small parts, PIM is a very attractive process, capable of great detail, geometric complexity, good material properties, good production rates, low generation of waste material and suitability to a wide variety of materials. But, for parts of large characteristic dimension or with highly variable cross section (e.g., a part with both thick- and thin-walled sections) it may be highly preferable to mold subcomponents and join them together after molding according to the process of the present invitation. Assembly of subcomponents also may allow design flexibility with a minimum investment in tooling costs. The application of the described process would allow joining small individually molded objects, with significantly simpler tooling, into one object, prior to sintering, in effect creating a larger object of uniform properties and microstructure.

A second representative situation involves green machining. Green machining, as implied by the term, is the process of machining powder compacts prior to binder burnout and sintering. Its advantages include low cost, high throughput, and material flexibility, because the material is softer in the green state and because machining behavior is determined by the nature of the binder rather than that of the powder particles. It is a widely used process. Green machining has geometric limitations that are analogous to those associated with conventional machining, i.e., complex concave surfaces can be very time intensive, require complex fixturing, and be costly. In addition, internal features may be completely inaccessible. Machining of subcomponents to be subsequently joined using the invention described herein will allow more complex parts to be machined, more economically.

A third representative situation is directed to Solid Freeform Fabrication (SFF). SFF is an emerging technology, often used for rapid prototyping, where solid objects are made without the use of traditional tools, such as molds and dies. In SFF, three dimensional computer models are stratified via computational software into separate layers which are used to direct layered-based manufacturing methods to form the three dimensional objects. One type of layered-based manufacturing uses thin sheets of material from which is cut the outline of each layer. Proper alignment and lamination of these layers produces a representation of the computer model. By utilizing a sheet formed of a carrier fluid and powder mixture, for example, powder injection molding feedstock, and using the joining method described herein, metallic or ceramic or glass objects of uniform structure may be fabricated. A second type of layered-based manufacturing uses thick layers of material and machine tools to form the geometry. By utilizing the process described herein, such layers, composed of a powder injection molding feedstock, may be joined creating a single object of uniform structure. Prior realization of the second method of rapid prototyping has been done by combining conventional brazing technology with machined dense metallic blocks.

The present invention contemplates a new and improved process which enables the fabrication of complex and non-complex objects, both metallurgical and non-metallurgical, using powder processing technology.

SUMMARY OF THE INVENTION

In accordance with the present invention, there is provided a process for producing inorganic powder bodies by joining smaller inorganic powdered parts together such that the joint between the parts formed from the inorganic powder have structural, mechanical, electrical, thermal and corrosion resistance characteristics that are essentially indistinguishable from the parent objects after processing is complete.

A process for joining green inorganic powder bodies calls for forming two green state powder compacts. The powder compacts are comprised of an inorganic powder, such as a metal, a ceramic or glass, and a binder. At least one of the powder compacts has a porous region at least adjacent a surface thereof where a lamination joint will be made. A polymer is introduced between two of said powder compact surfaces in contact with the porous region to form a sandwiched structure. The polymer is softened, for example, either by the application of heat or the application of a chemical. The formed aggregate body is then thermally processed to remove the binder and polymer and achieve a desired density. There is no discernable boundary at the lamination joint.

When correctly executed, green state joining offers a number of advantages. First, it permits joints to be formed that are completely erased during the final step in processing so that homogeneous and uniform parts can be produced. Secondly, a wide variety of materials can be joined using the same process since the joint is formed with the carrier fluid rather than directly with the inorganic powder particles. Thirdly, materials that are difficult to weld or braze, due to reactivity or brittleness, can be easily joined.

Other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment which will be described in detail in this specification and illustrated in the accompanying drawings which form a part hereof.

DETAILED DESCRIPTION OF THE PREFERRED EMBODIMENTS

The present invention is directed to a process for joining the surfaces of the powder metallurgy bodies containing a powder metal and a polymer binder. The polymer binder is removed from the surfaces of the bodies, thus forming a porous particle network. A polymer film is applied at the joint between the surfaces, and then softened or liquefied. The softened polymer film flows into the porous particle network and allows the metal particles from the two surfaces to come together to form a lamination joint. The polymer film can be chosen to be of the same composition as one of the components as the original binder system, or it may be of a different composition. Preferably, the nature of the polymer film is such that it is compatible with the conventional binder removal processes used in powder metallurgy and ceramic processing.

The powder compacts may be produced according to a standard process for fabricating PIM green bodies. The powder in the compacts is inorganic, generally of metal composition, although glass or ceramic powders can be used in the powder compacts that are joined together according to the process of the present invention. As produced, the powder compacts can be porous or nonporous. In either case, the compacts can be treated so as to create or increase their porosity either throughout their volume or in the region adjacent to the surfaces intended to be joined to other powder compacts. Porosity in the powder compacts can be achieved or improved in a number of different ways. For example, the powder compacts can be treated thermally to increase or create porosity. Alternatively, they can be treated chemically with a solvent, or other chemically reactive species. They can likewise be treated with electromagnetic radiation or in a capillary bed to create or increase their porosity. Another process for increasing or creating porosity is to expose them to a gaseous catalyst, such as by using an atmosphere containing a catalytic species.

Figure 1:
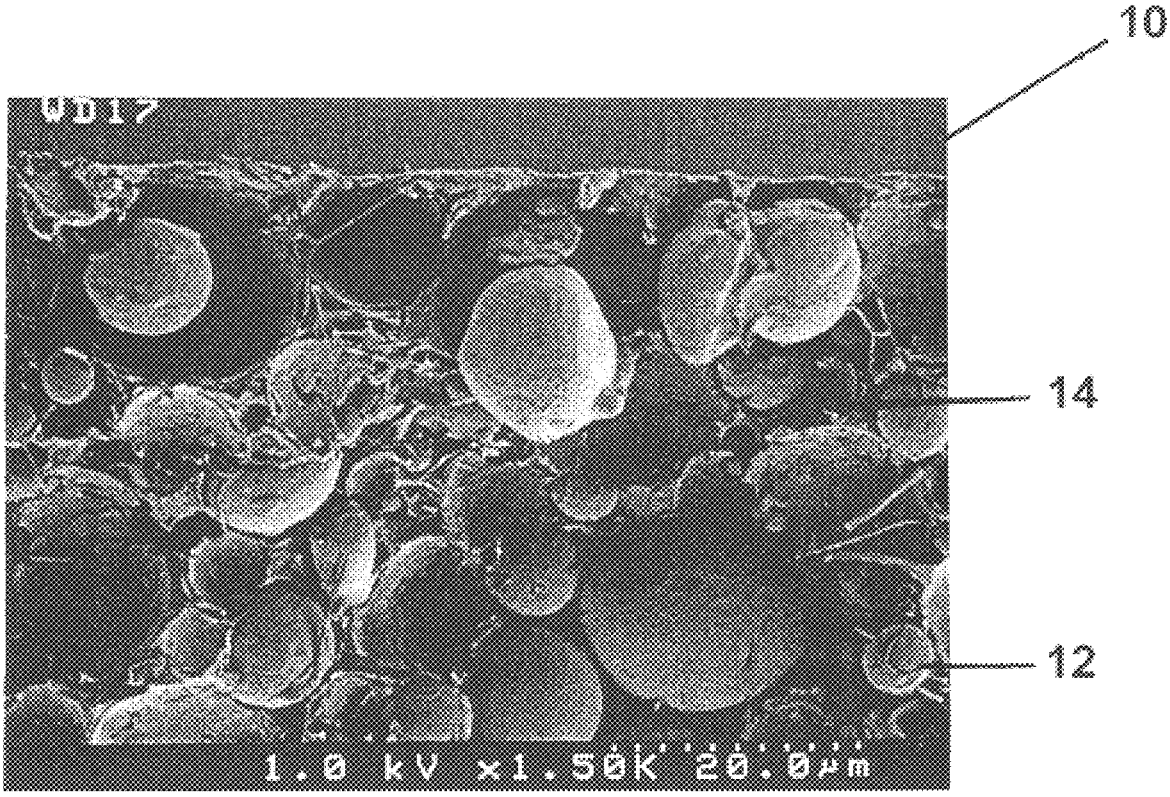
FIG. 1 shows a partial sectional view of a body or powder compact formed by a metal injection molding process.

Turning now to the figures, FIG. 1 shows a sectional view of a green body 10 composed of powder injection molding feedstock. In this case the body is a sheet with a thickness of 600 $\mu$m. The feedstock is composed of a metal powder 12 and a polymeric binder 14, usually consisting of at least two components plus additives, such as high molecular weight thermoplastics, waxes, oils, surfactants, plasticizers, etc. The proper combination of binder components and powder yields a mixture that can be molded like a conventional thermoplastic. Because the sheet was formed in a mold, the particle packing characteristics at the surface are not identical to that in the bulk of the sheet, i.e., there is a higher percentage of binder at the surface than at the interior. In order to join two bodies such that the sintered joint is indistinguishable from the bulk, particle-particle contacts must be formed along the interface of two surfaces such that the particle packing efficiency is similar to that of the interior. Hence, some amount of binder must be removed from the surface if this is to occur. In actual practice, an amount of binder is removed which is larger than that necessary to reduce the near-surface excess. In part, this is to provide open space within the compact to accommodate the addition of a polymer film to the joint.

Figure 2:
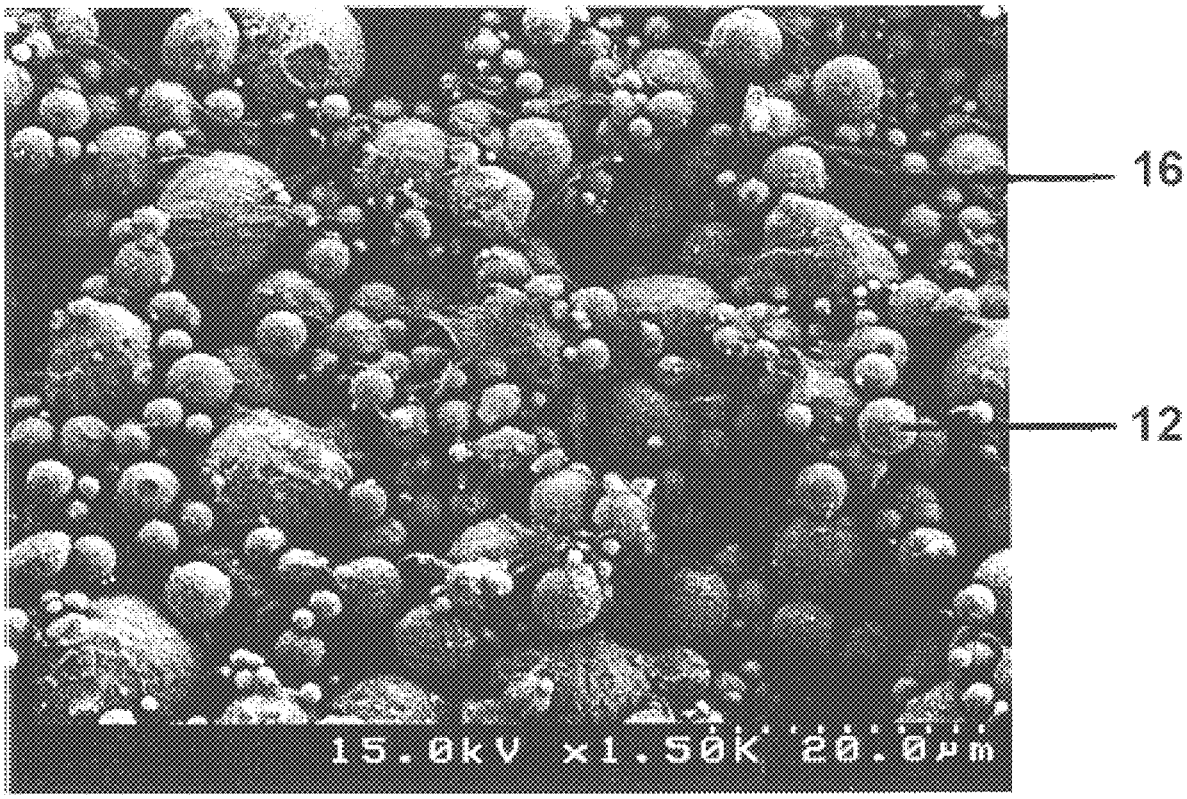
FIG. 2 shows a sectional view of the body or powder compact of FIG. 1 after a portion of the binder has been removed.

FIG. 2 shows a sectional view of the green body of FIG. 1 after removal of the polymeric binder. Some residual binder 16 remains. PIM feedstocks are formulated so that most (for example 95%) of the binder is removed prior to sintering, creating what is sometimes termed a "brown" body. Binder removal can be accomplished in several ways, for example acid etching, solvent leaching or thermal extraction. Since the binder removal has not been completed nor densification initiated, for the purposes of this invention a brown body is understood to represent a special case of a green body. This residual binder provides sufficient strength to the body to allow handling. The residual binder is eliminated in this case after joining during the initial stages of sintering. It is understood that if the primary shaping operation produces a porous powder compact, then this step is not required.

Figure 3:
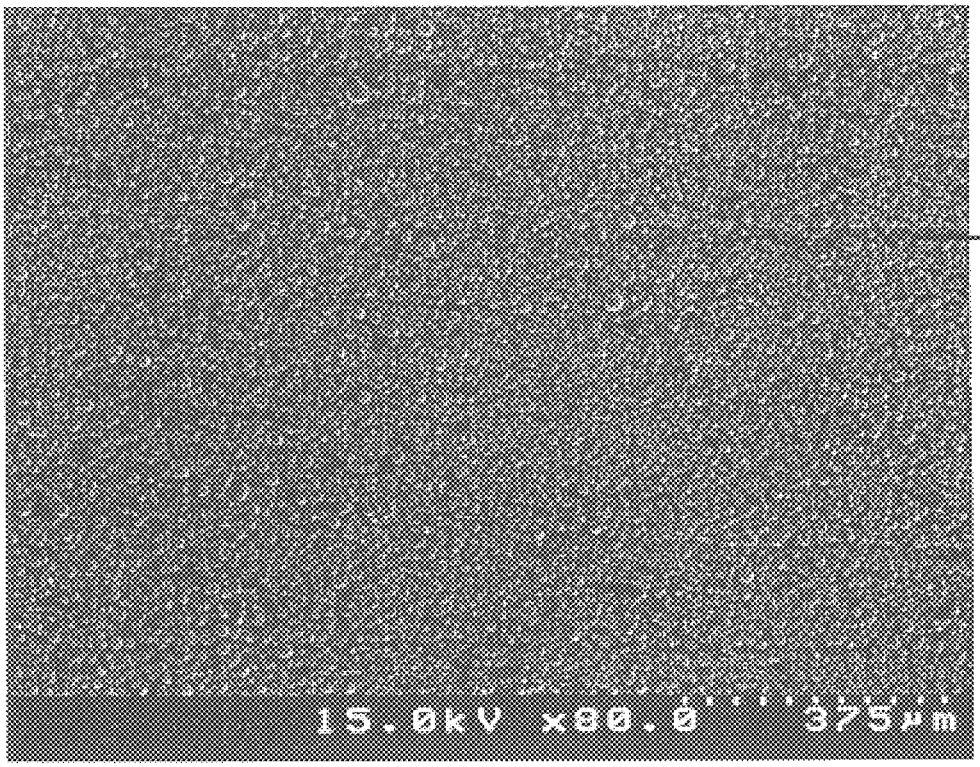
FIG. 3 shows a sectional view of an assemblage of two bodies or powder compacts that have had a portion of the binder removed.

FIG. 3 shows a sectional view of two stacked sheets or powder compacts in the brown condition. The metal particles are exposed, but because they are still held together by the residual binder, it is nearly impossible to obtain complete contact over a large interface 18, resulting in a different packing efficiency at the interface.

Figure 4:
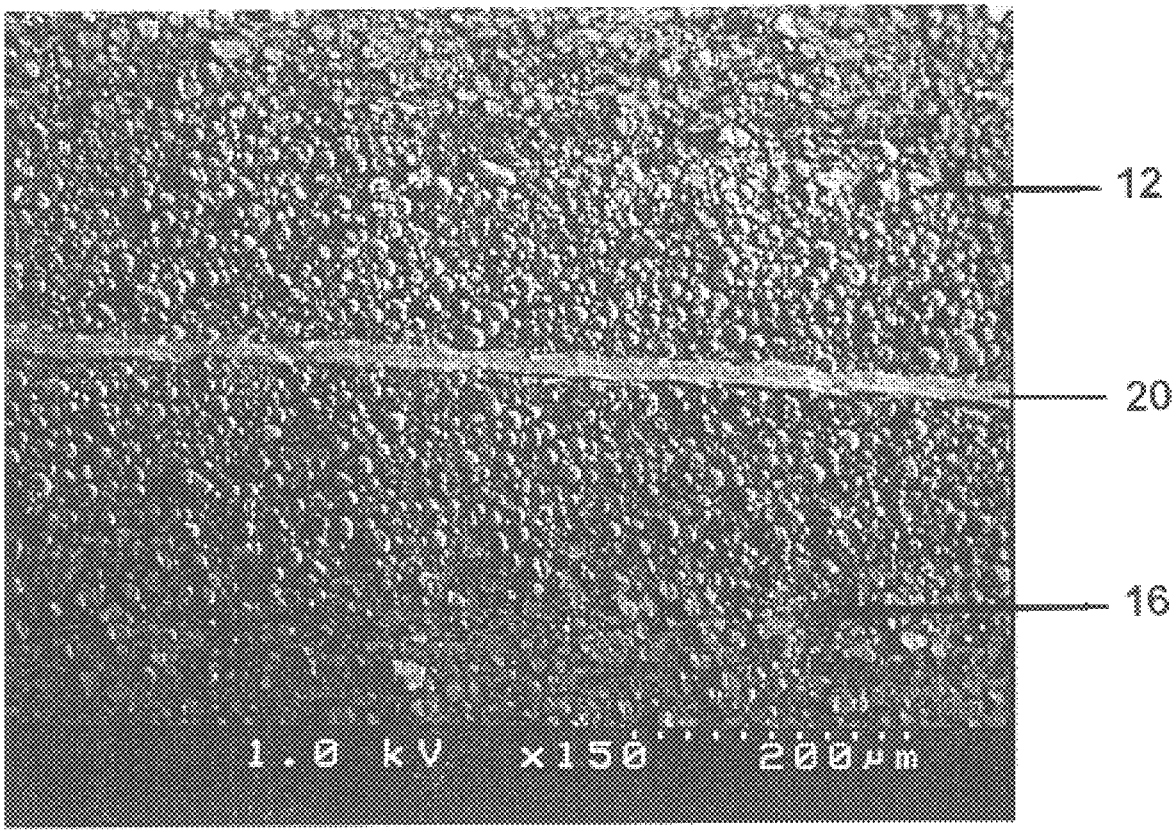
FIG. 4 shows a sectional view of an assemblage of two bodies or powder compacts which have had a portion of the binder removed and a film of polymer placed between them.

In order to obtain the desired uniform or homogenous particle packing, the particles at the interface must rearrange. To facilitate this, a thin polymer film 20 is placed between the two sheets or powder compacts, as illustrated in FIG. 4. This film can be in the form of a polymer powder, a polymer solution or a mixture of polymers. The polymer film can be softened by application of heat and/or chemicals including solvents and plasticizers, producing a liquid, which can flow into the particle network on either side. This liquid so formed is termed a "transient liquid" because it is ultimately removed from the powder compact during subsequent debinding. A mechanical load can be applied to assist in joining the powder components together, but it is not required in general. Under some conditions, the residual binder may also be softened by application of heat and/or chemical means. However, the powder body will be held together by the capillary forces of the fluid. In the regions were the transient liquid flows, the residual binder mixes with the transient liquid so that the metal particles become covered in liquid, and the capillary force becomes zero. The metal particles are then able to rearrange, eliminating the interface.

Given the fact that local rearrangement is taking place, it is appreciated that the implied symmetry of the above description, i.e., porosity/polymer film/porosity is not a requirement. The invention described herein includes asymmetrical arrangements such as a case in which one contacting surface is rendered porous while the contacting surface on the other part contains an excess amount of binder-like material, either as a natural result of the primary shaping process or due to some coating process. If these surfaces are brought together and the excess binder-like material is softened, the green microstructure would evolve in an manner analogous to that described above.

Figure 5:
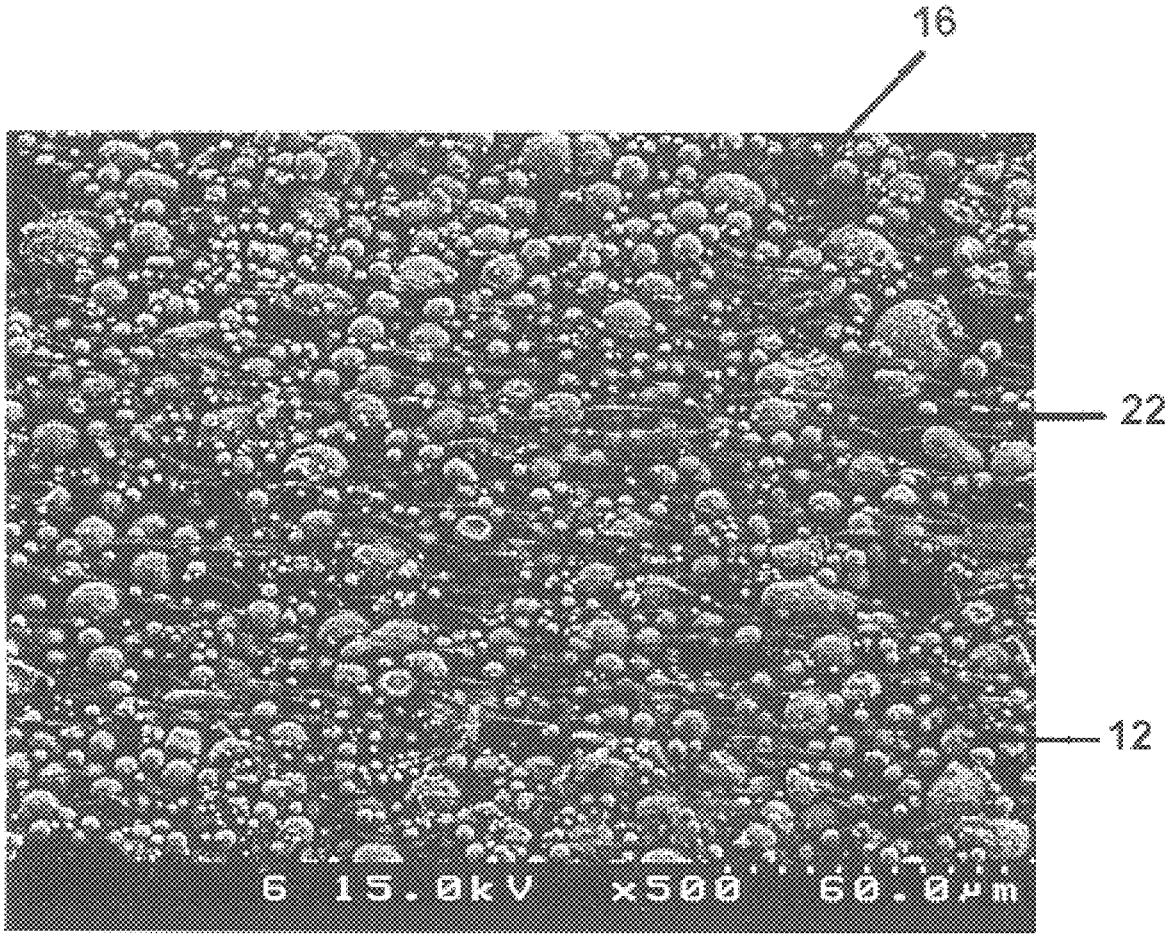
FIG. 5 shows a sectional view of the assemblage of FIG. 4 after redistribution of the polymer film.

After cooling to room temperature or removal of chemicals used to soften the binder film, the sectional view of the laminated region appears as illustrated in FIG. 5. The transient liquid (i.e. redistributed polymer film) 22 and residual binder 16 have solidified, producing a region of high binder concentration at the former interface. But, the critical aspect of this step of the joining process is that when complete, the particle packing of the laminated region is indistinguishable from that of the bulk.

Figure 6:
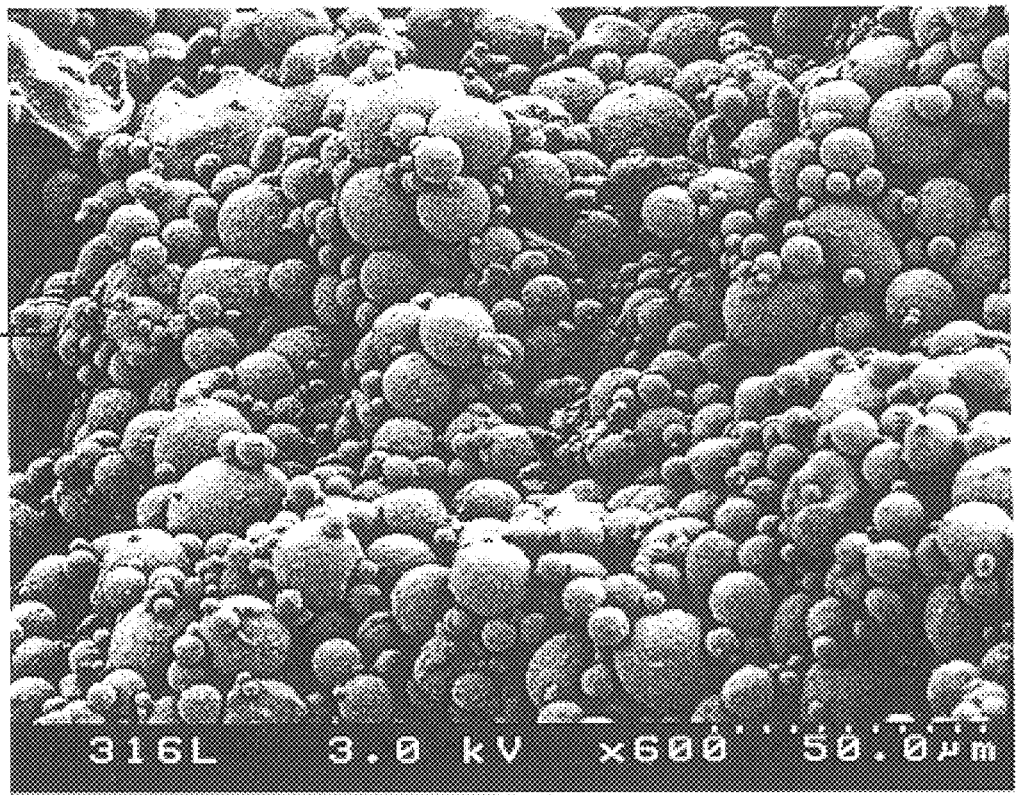
FIG. 6 shows a sectional view of the assemblage of FIG. 5 after all the binder has been removed.

The remaining binder is removed from the body during the initial stages of sintering. FIG. 6 shows a sectional view after removal of all binder and sintering at low temperature to grow small necks between the particles. The complete absence of a discernable boundary at the joint 24 in the structure is a unique result of this joining process. The joined green object has a uniform volume fraction of solids and a uniform particle distribution adjacent and removed from the lamination joint. Simultaneously, there can be a variation in porosity throughout. The formed green object has a homogenous inorganic powder distribution despite variations in amount and type of polymer within the compacts.

Figure 7:
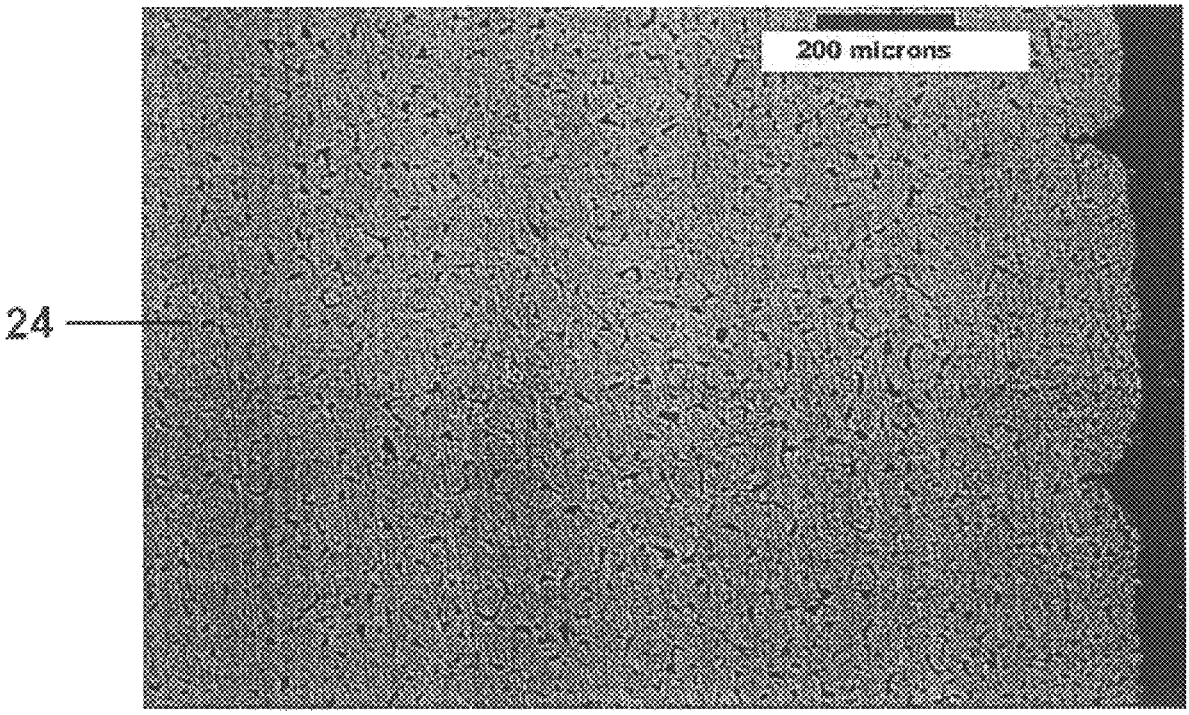
FIG. 7 shows a sectional view of the assemblage of FIG. 6 after complete sintering.

Upon complete sintering, the joint and bulk have similar microstructure, as exemplified in FIG. 7. No structural defects, such as cracks, differences in average grain size, density and chemical inhomogeneities are observed at the joint. The resultant joint has properties similar to those of the bulk.

In addition to generating a uniform final microstructure, a homogeneous particle distribution after joining yields uniform sintering rates and shrinkage throughout the body, thus mitigating any tendency for part warpage.

EXAMPLE

A steel gear is to be fabricated via a layered-based manufacturing technique. A PIM feedstock containing 64 volume percent 316L stainless and 45 volume percent binder (90% polyacetal and 10% polyethylene-polypropylene copolymer as disclosed in U.S. Pat. Nos. 5,043,121; 5,611,978; and 4,624,812) are used as the starting materials. The feedstock is formed into sheets of 500 μm thickness by extrusion. The near surface binder of the sheets of feedstock are then removed to a depth of looam using gaseous oxalic acid at 130° C. The polyacetal binder is removed, but the polyethylene-polypropylene binder is left unaffected. The unreacted core of polyacetal provides additional strength to handle the thin sheet without breaking it. The sheets are cut to form the layer geometries using a laser. A thin film of low-density polyethylene (LDPE) is also cut to closely match the contact area between each layer. These LDPE films are then coated with a layer of mineral oil. Alternating layers of feedstock and LDPE film are then stacked in the vertical direction to form an assemblage. The stack is heated to 145° C. for 45 minutes under a pressure of 2000 $N/m^2$. This produces the uniform particle packing characteristics required by softening the LDPE-mineral oil film and polyethylene-polypropylene copolymer binder at the interface of the layers so that the steel particles are redistributed local to the interface, yet the steel packing efficiency remains at 64 volume percent. The remaining polyacetal binder is removed by using gaseous oxalic acid at 130° C., and the remaining binder (a mixture of LDPE, mineral oil and polyethylene-polypropylene copolymer) is thermally removed during the initial stages of sintering. The body is conventionally sintered to high density producing a steel gear that is homogeneous and uniform. A part so produced will have a structure and set of properties that are not compromised by the joining history.

The invention has been described with reference to the preferred embodiment. Obviously modifications and alterations will occur to others upon a reading and understanding of this specification. It is intended to include all such modifications and alterations insofar as they come within the scope of the appended claims or the equivalent thereof.

We claim:

1. A process for joining green powder bodies to form an object, comprising the steps of:

forming two or more powder compacts each comprising an inorganic powder and a binder, at least one of said powder compacts having a porous region at least adjacent a surface thereof;

introducing a polymer between said two powder compact surfaces in contact with the porous region or regions to form a sandwiched structure;

softening the polymer in the sandwiched structure sufficiently to form an aggregate body under conditions wherein the bulk powder compacts retain their shape; and thermally processing the formed aggregate body to remove the binder and polymer, adhere the powder compacts to each other and achieve a desired uniform density wherein said object has no discernable microstructural variations at the joint.

2. A process for joining green powder bodies, as set forth in claim 1, comprising the additional step of:

thermally treating the powder compacts to create or increase porosity in each prior to the step of introducing a polymer between two powder compact surfaces.

3. A process for joining green powder bodies, as set forth in claim 1, comprising the additional step of:

treating the powder compacts with a solvent to create or increase porosity in each prior to the step of introducing a polymer between the two powder compact surfaces.

4. A process for joining green powder bodies, as set forth in claim 1, comprising the additional step of:

treating the powder compacts using an atmosphere containing a catalytic species to create or increase porosity in each prior to the step of introducing a polymer between the two powder compact surfaces.

5. A process for joining green powder bodies, as set forth in claim 1, comprising the additional step of:

treating the powder compacts in a chemically reactive atmosphere to create or increase porosity in each prior to the step of introducing a polymer between the two powder compact surfaces.

6. A process for joining green powder bodies, as set forth in claim 1, comprising the additional step of:

treating the powder compacts in a capillary bed to create or increase porosity in each prior to the step of introducing a polymer between the two powder compact surfaces.

7. A process for joining green powder bodies, as set forth in claim 1, comprising the additional step of:

treating the powder compacts with electromagnetic radiation to create or increase porosity in each prior to the step of introducing a polymer between the two powder compact surfaces.

8. A process for joining green powder bodies, as set forth in claim 1, wherein the polymer that is introduced between the powder compact surfaces comprises a polymer powder.

9. A process for joining green powder bodies, as set forth in claim 1, wherein the polymer that is introduced between the powder compact surfaces comprises a polymer solution.

10. A process for joining green powder bodies, as set forth in claim 1, wherein the polymer that is introduced between the powder compact surfaces comprises a solid sheet of polymer.

11. A process for joining green powder bodies, as set forth in claim 1, including the additional step of:

applying a mechanical load to the sandwiched structure to assist in joining the powder compacts together.

12. A process for joining green powder bodies, as set forth in claim 1, wherein the step of softening includes a step of introducing a chemical softening agent into the polymer.

13. A process for joining green powder bodies, as set forth in claim 1, wherein the step of softening includes a step of heating the polymer.

14. A process for joining green powder bodies, according to claim 1, wherein the inorganic powder in the compact is a metal powder.

15. A process for joining green powder bodies, according to claim 1, wherein the inorganic powder in the compact is a glass powder.

16. A process for joining green powder bodies, according to claim 1, wherein the inorganic powder in the compact is a ceramic powder.

17. A process for joining green bodies to form an object, comprising the steps of:

forming two powder compacts each comprising an inorganic powder and a binder, at least one of said powder compacts having a porous region at least adjacent a surface thereof;

introducing a polymer between said two powder compact surfaces in contact with the porous region to form a sandwiched structure;

softening the polymer to form an aggregate body; and thermally processing the formed aggregate body to remove the binder and polymer, adhere said two powder compacts to each other, achieve a desired density and to form an object, wherein said object formed has no discernable boundary layer.

18. A process for joining green bodies, as set forth in claim 17, wherein the inorganic powder in the compact is a ceramic.

19. A process for joining green bodies, as set forth in claim 17, wherein the inorganic powder in the compact is a glass.

20. A process for joining green bodies, as set forth in claim 17, wherein the inorganic powder in the compact is a metal.

21. A process for joining green powder bodies, comprising the steps of:

providing two powder compacts comprising a metal and a binder, at least one of said powder compacts having a porous region at least adjacent a surface thereof;

placing the two said powder compacts in contact with each other at the porous region;

softening the binder present in said powder compacts;

heating two powder compacts sufficiently to form an aggregate body; and thermally processing the formed aggregate body to remove the binder and achieve a desired density.

22. A process for joining green powder bodies, as set forth in claim 21, wherein the step of thermally processing includes a subsidiary step of sintering.

23. A process for joining green powder bodies, as set forth in claim 21, wherein the step of thermally processing includes a subsidiary step of infiltration to densify the aggregate body.

24. A process for joining green powder metallurgy bodies, as set forth in claim 21, wherein the step of softening includes a step of introducing a chemical softening agent between two of said powder compact surfaces that are in contact with each other.

25. A process for joining green bodies to form an object comprising the steps of:

forming two or more green bodies comprising an inorganic powder and a binder or binders, each of said powder compacts having a porous region adjacent a surface thereof;

introducing a polymer between said green bodies in contact with the porous region or regions to form a sandwiched structure;

softening the polymer in the sandwiched structure to form an aggregate body under conditions wherein the bulk powder compacts retain their shape; and thermally processing the formed aggregate body to remove the binder and polymer and adhere the two powder compacts to each other, thereby forming a green object that can be post-processed to yield a composite part of desired density.

26.A joined green object formed by the process of claim 1.

27. A joined green object formed by the process of claim 25.

* * * * *